US007549602B2

(12) United States Patent
Inugai et al.

(10) Patent No.: US 7,549,602 B2
(45) Date of Patent: Jun. 23, 2009

(54) TAPE CARTRIDGE

(75) Inventors: Yasuo Inugai, Ibaraki (JP); Hideyuki Tanaka, Ibaraki (JP); Keiji Ban, Ibaraki (JP)

(73) Assignee: Hitachi Maxell, Ltd., Ibaraki-shi (JP)

( * ) Notice: Subject to any disclaimer, the term of this patent is extended or adjusted under 35 U.S.C. 154(b) by 172 days.

(21) Appl. No.: 11/724,200

(22) Filed: Mar. 15, 2007

(65) Prior Publication Data

US 2008/0017740 A1 Jan. 24, 2008

(30) Foreign Application Priority Data

Mar. 22, 2006 (JP) ..... 2006-079511
Sep. 14, 2006 (JP) ..... 2006-249615
Sep. 14, 2006 (JP) ..... 2006-249616

(51) Int. Cl.
*B65H 75/22* (2006.01)

(52) U.S. Cl. ..... 242/348; 242/608.2; 242/609.2

(58) Field of Classification Search ..... 242/332.4, 242/348, 348.2, 348.4, 608, 608.2, 608.4, 242/608.6, 609, 609.2
See application file for complete search history.

(56) References Cited

U.S. PATENT DOCUMENTS 1,924,977 A * 8/1933 Buhler ..... 242/609.2
2,574,883 A * 11/1951 Medal ..... 242/587.3
3,353,660 A * 11/1967 Will ..... 206/406
3,415,458 A * 12/1968 Newell ..... 242/608.6
3,612,424 A * 10/1971 Friedel ..... 242/348.4
4,039,156 A * 8/1977 Abraham ..... 242/608.4
4,078,741 A * 3/1978 Underwood ..... 242/608.6
4,741,439 A * 5/1988 Bizic ..... 242/348
6,062,500 A * 5/2000 Coles ..... 242/332.8
2003/0189128 A1* 10/2003 Soepnel et al. ..... 242/608.4

FOREIGN PATENT DOCUMENTS

JP 7-5691 Y2 2/1995
JP 2006-65987 A 3/2006

* cited by examiner

*Primary Examiner*—William A Rivera
(74) *Attorney, Agent, or Firm*—Birch, Stewart, Kolasch & Birch, LLP

(57) ABSTRACT

A tape cartridge suitable for high density recording of information signals is provided by enhancing the form accuracy and the assembly precision of a flange fixed to a hub to achieve a high-precision tape reel. The tape reel is placed inside a main casing for winding and storing a recording tape. The tape reel is composed of an upper flange and a hub integrally having a lower flange. The upper flange joined to the upper surface of the hub is fastened and fixed with a screw screwed into the hub from the upper side of the upper flange. The upper flange is fastened and fixed to the hub with a plurality of screws provided in positions away from the central axis of rotation of the tape reel.

29 Claims, 15 Drawing Sheets

TAPE CARTRIDGE

BACKGROUND OF THE INVENTION

The present invention relates to a tape cartridge in which a tape reel includes a pair of upper and lower flanges and a hub for winding a tape thereonto.

In the tape reel composed of a pair of upper and lower flanges and a hub, one side of the hub is often molded integrally with one of the flanges, while the other flange is fixed to the hub. In the conventional tape reel, the latter flange is fixed to the end face of the hub by ultrasonic welding (see JP 2006-65987 A and JP H7-5591 Y).

In the above fixing structure in which the flange is fixed by ultrasonic welding, a deposited piece is melt and deformed with frictional heat relating to supersonic vibration, and therefore it is inevitable that the remaining stress from the time of flange molding is locally relaxed by melting heat of the deposited piece. Consequently, even if there was no problem in molding precision of the flange before ultrasonic welding, a part of the flange have sometimes deformed toward the thickness direction, or the angle of gradient of the flange face have changed locally after ultrasonic welding, which caused a problem in enhancing the finishing precision of the tape reel.

What is necessary for preventing the deformation of the flange relating to such ultrasonic welding is, for example, to mold the flange in anticipation of the release and deformation of the remaining stress. To this end, however, test molding and correction of a metallic mold need to be repeated, which takes long time and large costs. Further, since the deformation amount of the flange differs with variation in form of the deposited piece or with a slight difference in excitation conditions by a welding horn, there are limitations in enhancing the form accuracy of the flange which is to be fixed by welding, even if the flange is molded in anticipation of the release of the remaining stress.

SUMMARY OF THE INVENTION

The inventors of the present invention have focused on the point that the form accuracy of the flange before ultrasonic welding is sufficiently high and the point that the deformation never occurs unless the remaining stress from the time of molding is not released. As a result of examining the fixing structure of the flange which takes advantage of both the points, the inventors have come to propose the present invention.

According to the present invention, there is provided a tape cartridge, comprising a tape reel placed inside a main casing for winding and storing a recording tape, the tape reel being constituted from a pair of upper and lower flanges and a hub, wherein at least one flange is fastened and fixed by a screw fixing structure which uses, as a fixing element, a screw body screwed into the hub from an external surface side thereof.

The tape cartridge of the present invention may include the screw fixing structure and an engaging structure provided in joint surfaces of the hub and the flange so as to be engaged with each other.

In the tape cartridge of the present invention, the screw body may be located so that a screw shaft center of the screw body is positioned on a central axis of rotation of the tape reel.

In the tape cartridge of the present invention, the screw body in the screw fixation structure may be provided in a position away from a central axis of rotation of the tape reel.

In the tape cartridge of the present invention, the flange may be fastened and fixed to the hub by a plurality of the screw bodies.

The tape cartridge of the present invention may include the screw fixing structure and at least one engaging structure provided in joint surfaces of the hub and the flange so as to be engaged with each other, in which the engaging structure may be constituted from a joint recess section provided in a center of the flange and a connection seat provided in a hub end wall of the hub so as to be interfitted with the joint recess section.

The tape cartridge of the present invention may include the screw fixing structure and at least one engaging structure provided in joint surfaces of the hub and the flange so as to be engaged with each other, in which a plurality of the engaging structures may evenly be placed on a virtual circle centering on a rotational center of the tape reel, and the engaging structure may be constituted from a projection and a recess section which interfit in a joint direction of the flange and the hub.

The tape cartridge of the present invention may include the screw fixing structure and at least one engaging structure provided in joint surfaces of the hub and the flange so as to be engaged with each other, in which a plurality of the engaging structures may evenly be placed on a virtual circle centering on a rotational center of the tape reel, and the engaging structure may be constituted from a clasp-shaped engaging body provided on opposed faces of the flange and the hub so as to be engaged with each other in a circumferential direction.

The tape cartridge of the present invention may include the screw fixing structure and at least one engaging structure provided in joint surfaces of the hub and the flange so as to be engaged with each other, in which the flange and the hub may be interfitted and engaged with each other on joint surfaces therebetween in a joint direction, a plurality of the engaging structures may evenly be placed along an interfitting surface of the flange and the hub, and the engaging structure may be constituted from a projection and a recess section which interfit in a diameter direction on the interfitting and engaging surface.

In the tape cartridge of the present invention, the screw body may be made from magnetically attractable magnetic metal, and the screw body may be provided in a reel end wall right opposite to a magnet provided in a driving shaft of the tape drive.

In the tape cartridge of the present invention, the screw body may be made from magnetically attractable magnetic metal, a plurality of the screw bodies may be provided on a reel end wall right opposite to a magnet provided in a driving shaft of the tape drive, and a plurality of the screw bodies may be right opposite to the magnet provided in the driving shaft of the tape drive and be placed at regular intervals in a circumferential direction in a ring-shaped region of a reel end wall which are joined to the magnet.

In the tape cartridge of the present invention, the screw body may be made from magnetically attractable magnetic metal, the screw body may be provided in a reel end wall right opposite to a magnet provided in a driving shaft of the tape drive, and an attracting face constituted from a flat face flush with the reel end wall may be formed at an outer edge of an operation head of the screw body.

In the tape cartridge of the present invention, a passive gear which gears with a gear drive provided in a driving shaft of a tape drive may be formed on an external surface of the flange.

Further in the tape cartridge of the present invention, at least either the flange or the hub may be molded with the a resin composition.

In the tape cartridge according to the present invention, a tape reel was formed by fastening and fixing at least one flange by a screw fixing structure which uses, as a fixing element, a screw body screwed into the hub from an external surface side (corresponding to claim 1). Thus, if the flange is mechanically fastened and fixed to the hub by the screw fixing structure, heat deformation of the flange face at the time of hot welding which was inevitable in the conventional tape reel can be swept away, so that the flange and the boss molded with high-accuracy form and size can be integrated while the form accuracy of both the flange and the boss is maintained high.

Therefore, according to the present invention, it becomes possible to enhance the assembled shape and the deflection width of the flange fixed to the hub as well as the taper accuracy of the flange face so as to constitute a high-precision tape reel, so that a tape cartridge suitable for high density recording of information signals can be obtained. Moreover, it becomes possible to omit time and effort indispensable for molding the flange in anticipation of the release and deformation of the remaining stress, by which the high-precision tape reel can be offered at lower costs.

By structuring the tape reel so as to include a screw fixing structure and an engaging structure which is provided in joint surfaces of the hub and the flange so as to be engaged with each other, the flange can be mechanically fastened and fixed to the hub by the screw fixing structure and the engaging structure. This makes it possible to prevent the screw from loosening due to inertial force of the reel rotated at high speed (corresponding to claim 2).

In this case, if the screw shaft center of the screw body in the screw fixing structure is positioned on the central axis of rotation of the tape reel, the torque of the hub can certainly be transmitted to the flange by the engaging structure and further, the flange and the hub can be fastened and fixed inseparably with the screw body. This ensures that the flange can be prevented from rotating in relation to the hub and that the screw body can be prevented from loosening (corresponding to claim 3). In short, the engaging structure can prevent the flange from rotating in relation to the hub, thereby ensuring that the screw body can be prevented from loosening.

Moreover, if the screw body in the screw fixation structure is provided in a position away from the central axis of rotation of the tape reel, the torque of the hub can certainly be transmitted to the flange by the engaging structure and further, the flange and the hub can be fastened and fixed inseparably with the screw body. This ensures that the flange can be prevented from rotating in relation to the hub and that the screw body can be prevented from loosening (corresponding to claim 4). In short, the screw fixing structure can prevent the flange from rotating in relation to the hub, thereby ensuring that the screw body can be prevented from loosening.

If the flange is fastened and fixed to the hub by a plurality of the screw bodies, it becomes possible to effectively prevent the flange from being displaced or the joint section with the hub in the flange from being damaged by the external shock and the like (corresponding to claim 5).

If the engaging structure is constituted from a joint recess section provided in the center of the flange and a connection seat provided in the bottom wall of the hub so as to be fitted into the joint recess section, both the flange and the hub can be concentrically positioned by the joint recess section and the connection seat in the state where the flange is interfitted and engaged to the hub, so that the flange can be fixed to the hub with higher accuracy (corresponding to claim 6).

According to the structure in which a plurality of the engaging structures, each constituted from a projection and a recess section interfitted in the joint direction of the flange and the hub, are evenly placed on a virtual circle centering on the rotational center of the tape reel, the torque which acts on each engaging structure can be equalized, so that the tape reel can be rotated more smoothly. Since the projection and the recess section are placed evenly, trial fitting of the flange and the hub can easily be conducted without the necessity of giving consideration to alignment for fitting the flange to the hub (corresponding to claim 7).

According to the fixing structure in which the engaging structure is constituted from a clasp-shaped engaging body provided on opposed faces of the flange and the hub so as to be engaged with each other in a circumferential direction, the tape reel can be rotated more smoothly as in the above case while the engaging action of a pair of the engaging bodies can regulate so that the flange will not float nor be separated from the hub. As a result, the flange can be fastened and fixed with more certainty (corresponding to claim 8).

According to the fixing structure in which the engaging structure is constituted from a projection and a recess section which are interfitted in the diameter direction on the interfitting and engaging surface, and a plurality of engaging structures are evenly placed along the interfitting surface of the flange and the hub, the tape reel can be rotated more smoothly as in the above case while the projection and the recess section can be engaged in the state where the flange and the hub are concentrically positioned by the interfitting surfaces of the flange and the hub. This makes it possible to coincide the center of the flange more correctly with the center of the hub, and to achieve more smooth rotating operation of the flange at the time of high velocity revolution (corresponding to claim 9).

Since a screw formed from magnetically attractable magnetic metal is used to attract the magnet of the driving shaft so as to maintain the connecting state of the tape reel and the driving shaft, a ring-shaped attracting plate can be omitted compared with the conventional tape reel, and further the metallic mold structure for molding can be simplified by omitting the attracting plate, resulting in reduction in metallic mold costs. Consequently, the tape reel with high precision achieved as a whole can be manufactured at low costs (corresponding to claim 10).

If a plurality of the screw bodies are placed at regular intervals in the circumferential direction, magnetic attracting force can be made to act equally upon the tape reel, so that the engagement state of the gear drive and the passive gear which are provided in the driving shaft and the tape reel can be maintained proper on a constant basis (corresponding to claim 11).

If the attracting face flush with the reel end wall is formed in the outer edge of the operation head of the screw body, the tight contact area of the magnet and the attracting face can be increased, so that the tape reel can be magnetically attracted with certainty (corresponding to claim 12).

If the passive gear is formed in the external surface of the flange, the set value of the diameter dimension of the passive gear can be increased, so that inclination of the reel can promptly be regulated, and thereby the tape reel can constantly be rotated with a proper posture (corresponding to claim 13).

BREIF DESCRIPTION OF THE DRAWINGS

The present invention will be explained further with reference to the accompanying drawings, where like component members are designated by like reference numerals, in which.

DETAILED DESCRIPTION OF THE PREFERRED EMBODIMENTS

First Embodiment

Figure 1:
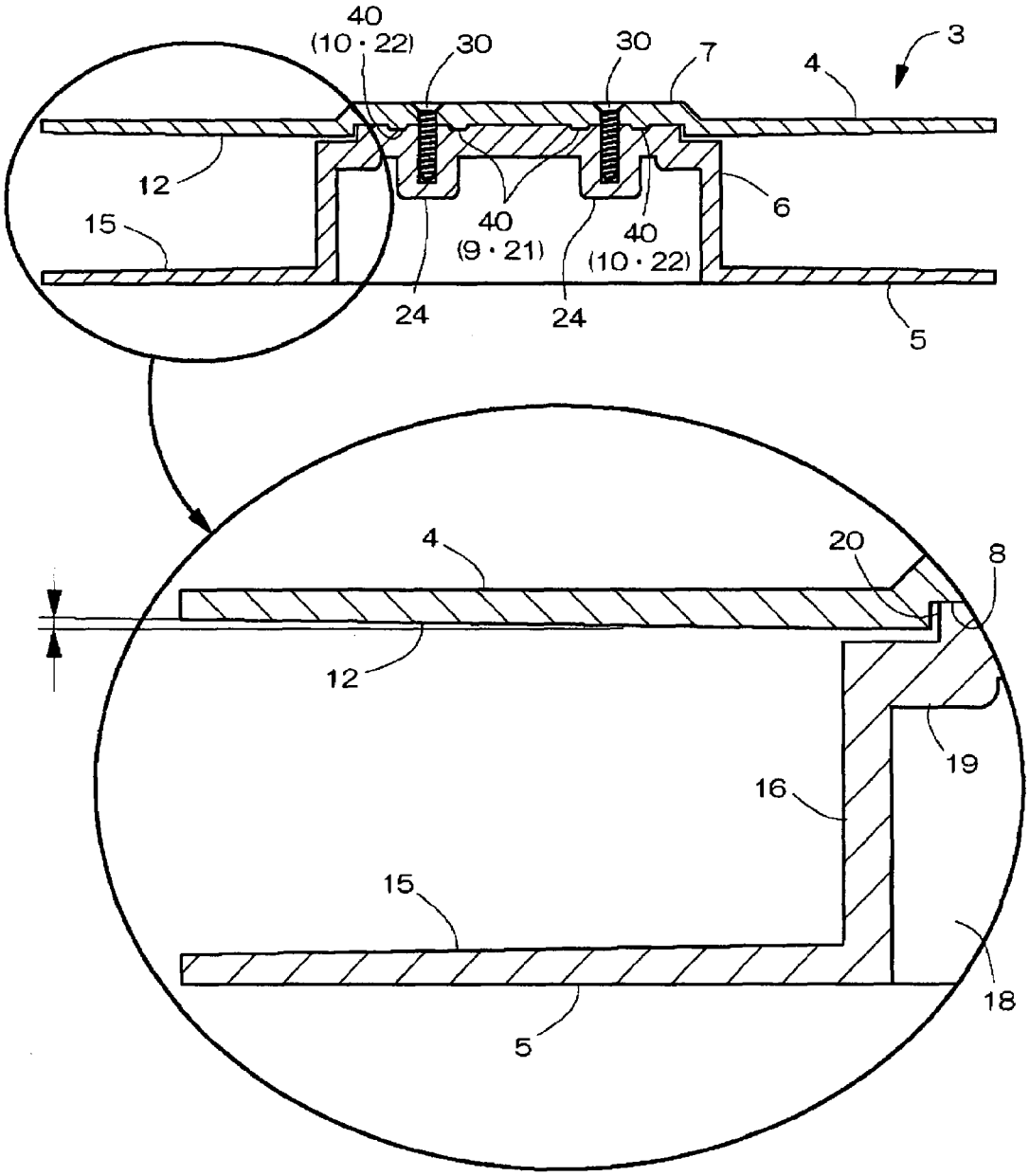
FIG. 1 is a vertical cross-sectional front view of a tape reel constituting a tape cartridge according to a first embodiment of the present invention.
Figure 2:
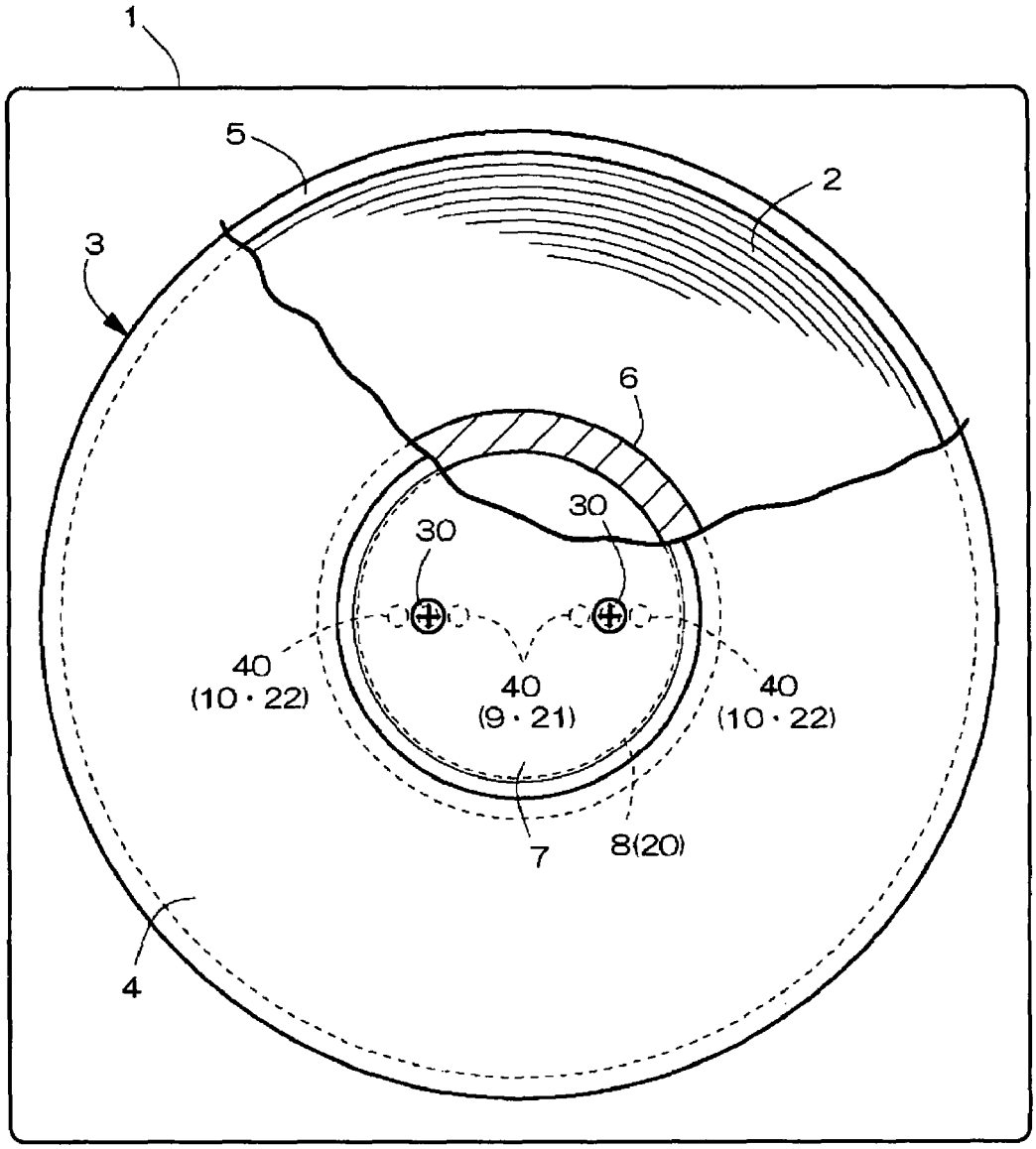
FIG. 2 is a schematic top view of the tape cartridge according to the first embodiment.
Figure 3:
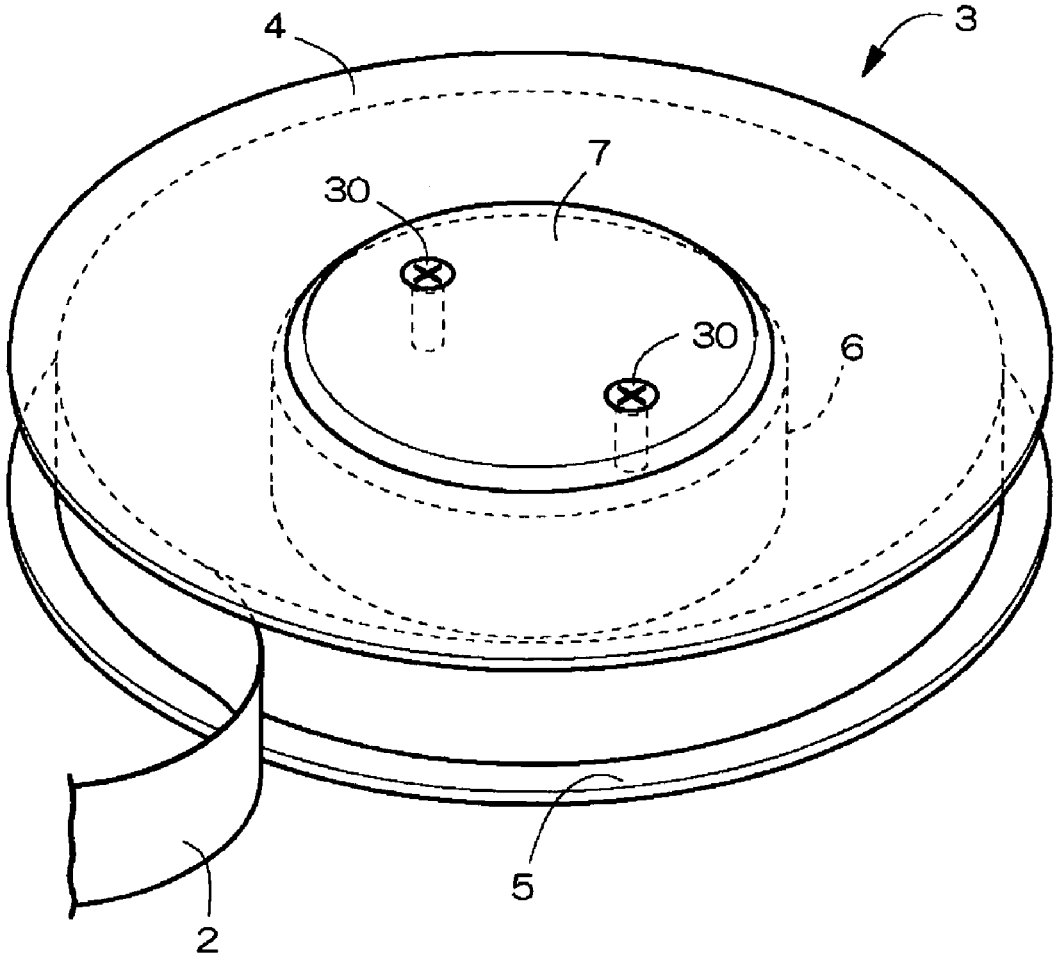
FIG. 3 is a perspective view of the tape reel according to the first embodiment.
Figure 4:
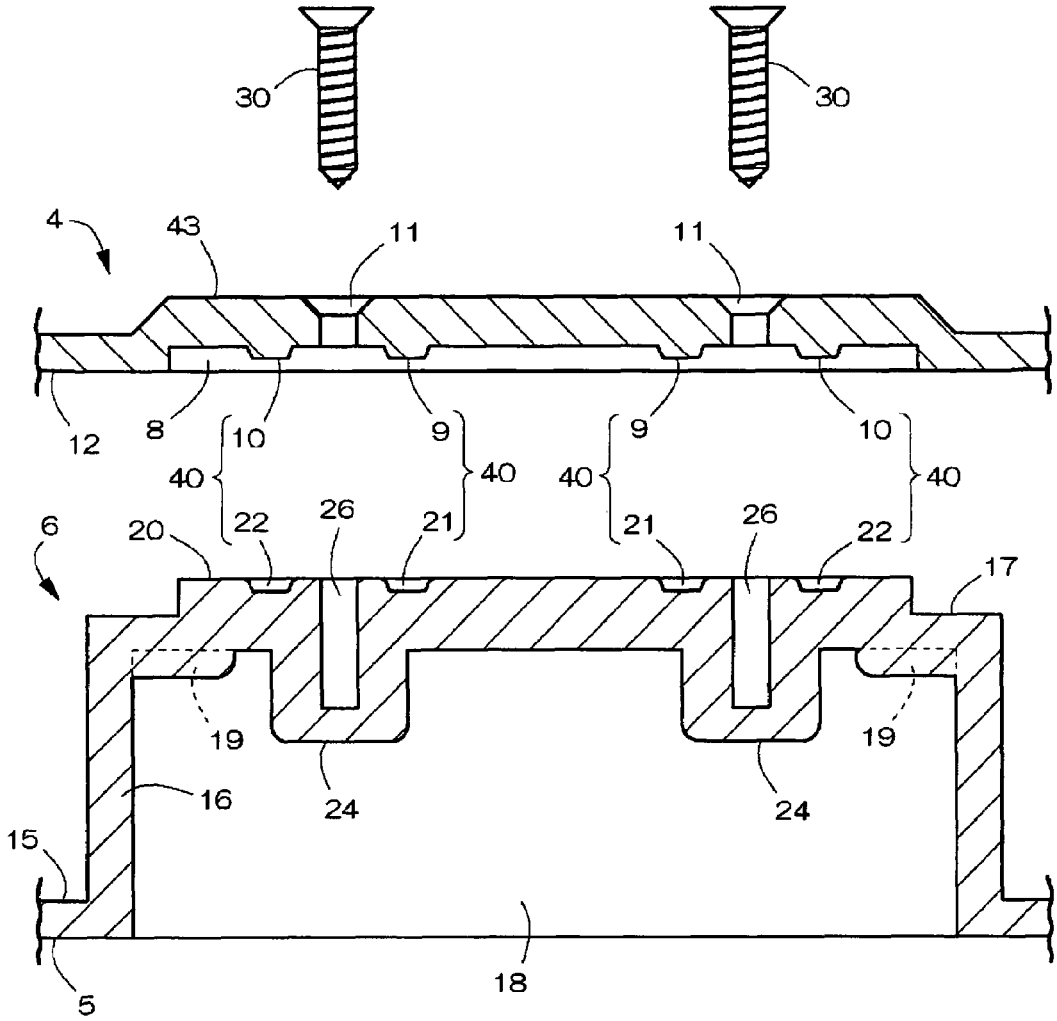
FIG. 4 is an exploded perspective view showing a joint structure of the tape reel according to the first embodiment.

A tape cartridge in the first embodiment of the present invention is shown in FIG. 1 or FIG. 4. In FIGS. 2 and 3, the tape cartridge is constituted as a so-called single reel-type tape cartridge having a tape reel 3 placed inside a box-like main casing 1 for winding and storing a recording tape 2 (e.g., magnetic tape). A leader block (unshown), which is fixed to a leading end of the magnetic tape 2, is caught and pulled out of the casing so that the magnetic tape 2 can be transmitted to a tape drive device.

The tape reel 3 is composed of an upper flange 4 and a hub 6 with which a lower flange 5 is integrally formed. As shown in FIG. 4, the upper flange 4 is constituted from a disc-like injection-molded product, with an upper bulging heavy-walled section 43 being formed in its center portion and a shallow joint recess section 8 being formed in the undersurface side of the heavy-walled section 43. A pair of inner and outer positioning projections (projections) 9, 10 which constitute an engaging structure 40 mentioned later is formed in the joint recess section 8, with two screw insert holes 11 formed between both the projections 9, 10. The upper part of the screw insert hole 11 is formed in a tapered shape narrowing downward corresponding to the operation head of a screw (screw body) 30 mentioned later. An upper taper surface 12 inclined upward to radial outside from radial inside is formed in the undersurface of the upper flange 4 except the joint recess section 8.

The lower flange 5 is formed in a disc shape like the upper flange 4, and a lower taper surface 15 inclined downward from radial inside to radial outside is formed on its upper surface. The hub 6 has, in a integral manner, a hub barrel 16 around which the magnetic tape 2 is wound and a hub end wall 17 sealing the upper surface of the hub barrel 16. The inside of the hub barrel 16 constitutes a drive hole 18 for inserting a driving shaft of a tape drive device. An engaging tooth 19 which engages with the driving shaft is formed around the upper surface of the drive hole 18. The lower flange 5 is formed extending to the lower end periphery of the hub barrel 16.

A connection seat 20 which fits into the joint recess section 8 is formed so as to bulge from the upper surface of the hub end wall 17, and a pair of inner and outer positioning recess sections (recess sections) 21, 22 are formed on its end face. A screw boss 24 is formed in two locations on both the right and left sides on the undersurface of the hub end wall 17. A prepared screw hole 26 which opens to the upper surface of the hub end wall 17 is formed in the screw boss 24. The engaging structure 40 according to the present invention is composed of these positioning projections 9, 10 and positioning recesses 21, 22.

After the joint recess section 8 of the upper flange 4 is put around the connection seat 20 of the hub end wall 17, each of the positioning projections 9, 10 is fitted in the positioning recesses 21, 22, in such a way that the center of the screw insert hole 11 is coincided with the center of the prepared screw hole 26, and the screw (screw body) 30 is screwed into the prepared screw hole 26 in this state, so that the upper flange 4 can be fixed to the hub 6 as shown in FIG. 1. In short, the upper flange 4 is fixable to the hub 6 with the screw fixing structure using the screw 30 as a fixing element and with the engaging structure 40. The operation head of the screw 30 in the fixed state is completely settled in the screw insert hole 11.

As mentioned above, when the upper flange 4 is fastened and fixed to the hub 6 with the screw 30, curvature deformation of the upper flange 4 attributed to welding heat unavoidable at the time of welding can be prevented with certainty, so that the amount of curvature deformation of the upper flange 4 and the inclined angle of the upper taper surface 12 can be maintained as they are in the state where injection molding has been completed. Therefore, it becomes possible to obtain the tape reel 3 in which the upper flange 4 is accurately joined and fixed to the hub 6 so as to be able to prevent disturbed winding such as stepped winding.

Two screws 30 are screwed into the prepared screw holes 26 placed in positions distant from the central axis of rotation of the tape reel 3 to fasten and fix the upper flange 4 to the hub 6. Therefore, even in the case where the tape reel 3 is rotated at high speed, the screw 30 can surely be prevented from loosening due to inertial force. In addition, the upper flange 4 is subjected to idle movement regulation by the positioning projections 9, 10 and the positioning recesses 21, 22, which makes it possible to effectively prevent the upper flange 4 from being displaced or the heavy-walled section 43 from being fractured by external impacts.

Second Embodiment

Figure 5:
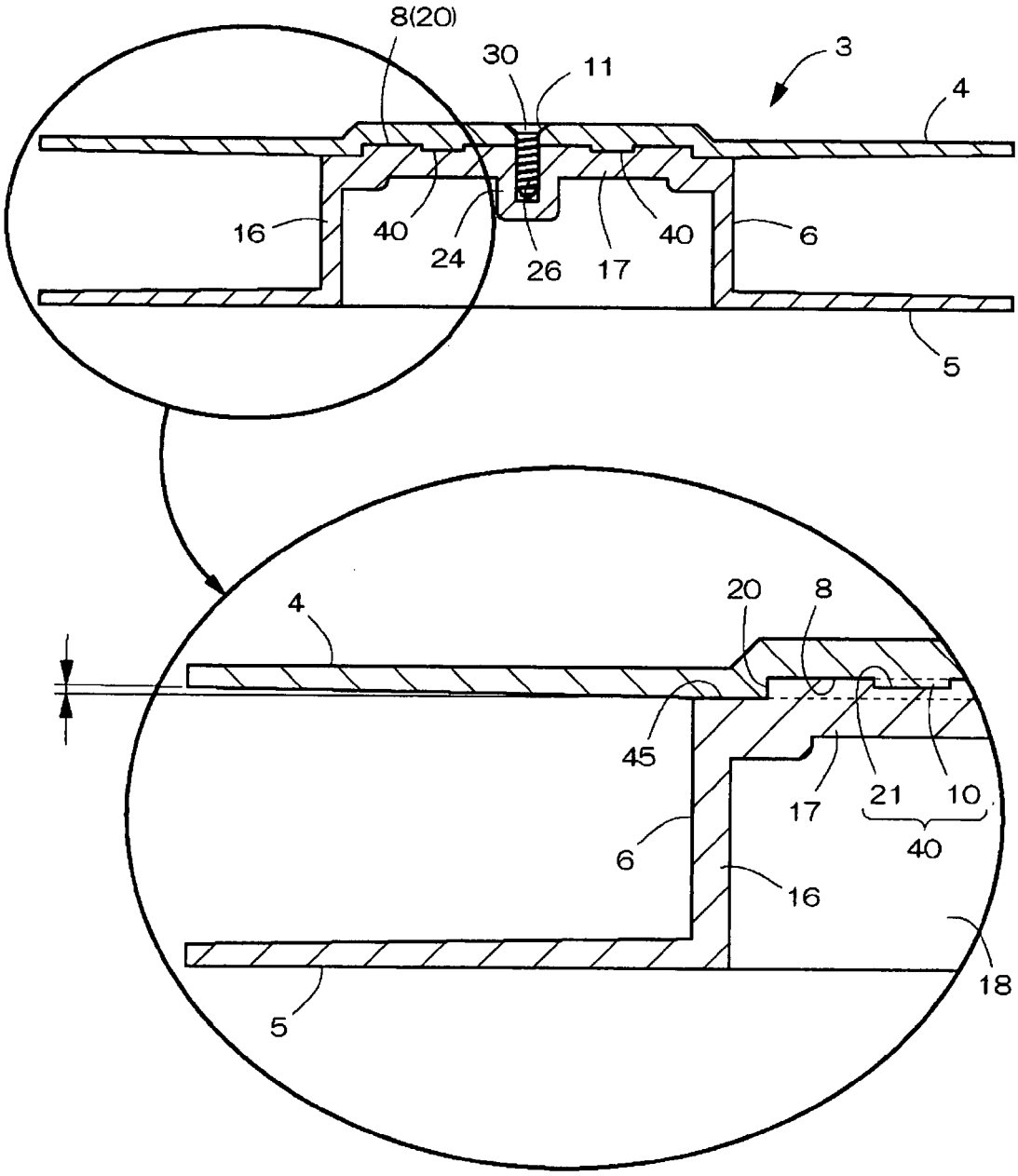
FIG. 5 is a vertical cross-sectional front view of a tape reel constituting a tape cartridge according to a second embodiment of the present invention.
Figure 8:
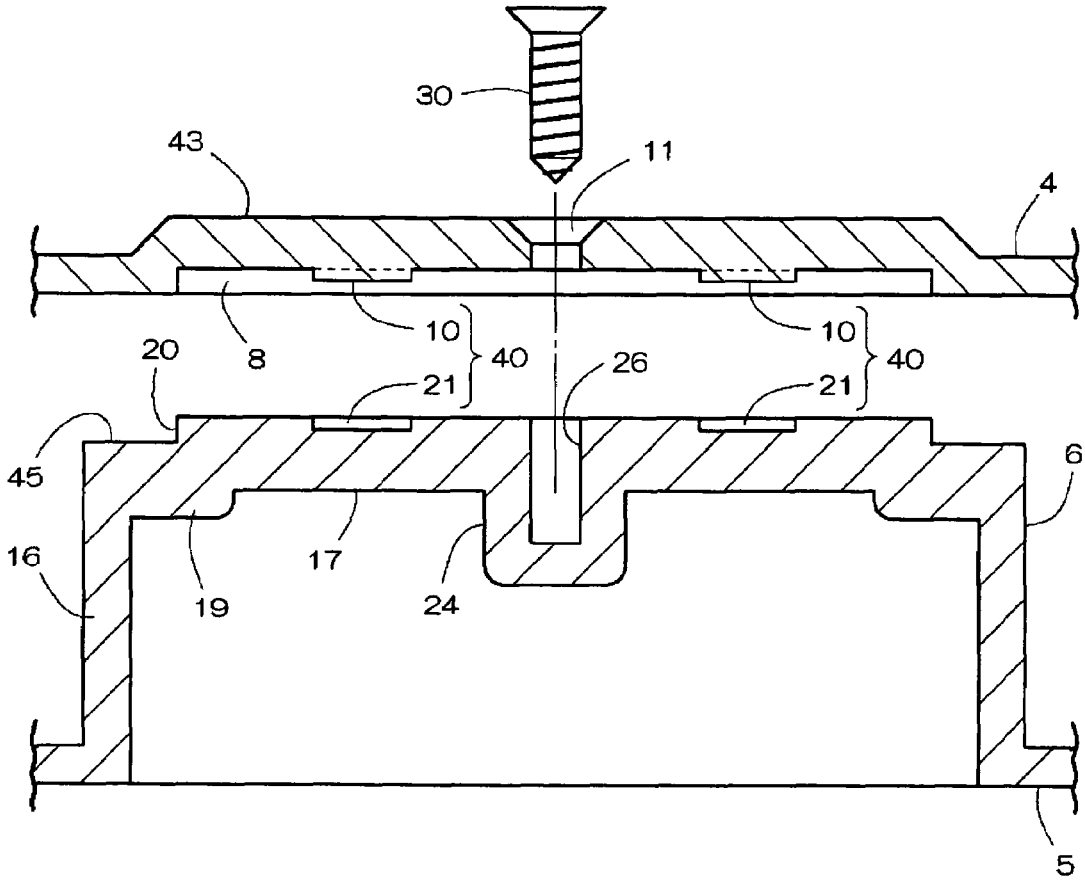
FIG. 8 is an exploded perspective view showing a fixing structure of the tape reel according to the second embodiment.

A tape cartridge in the second embodiment of the present invention is shown in FIG. 5 though FIG. 8.

Figure 6:
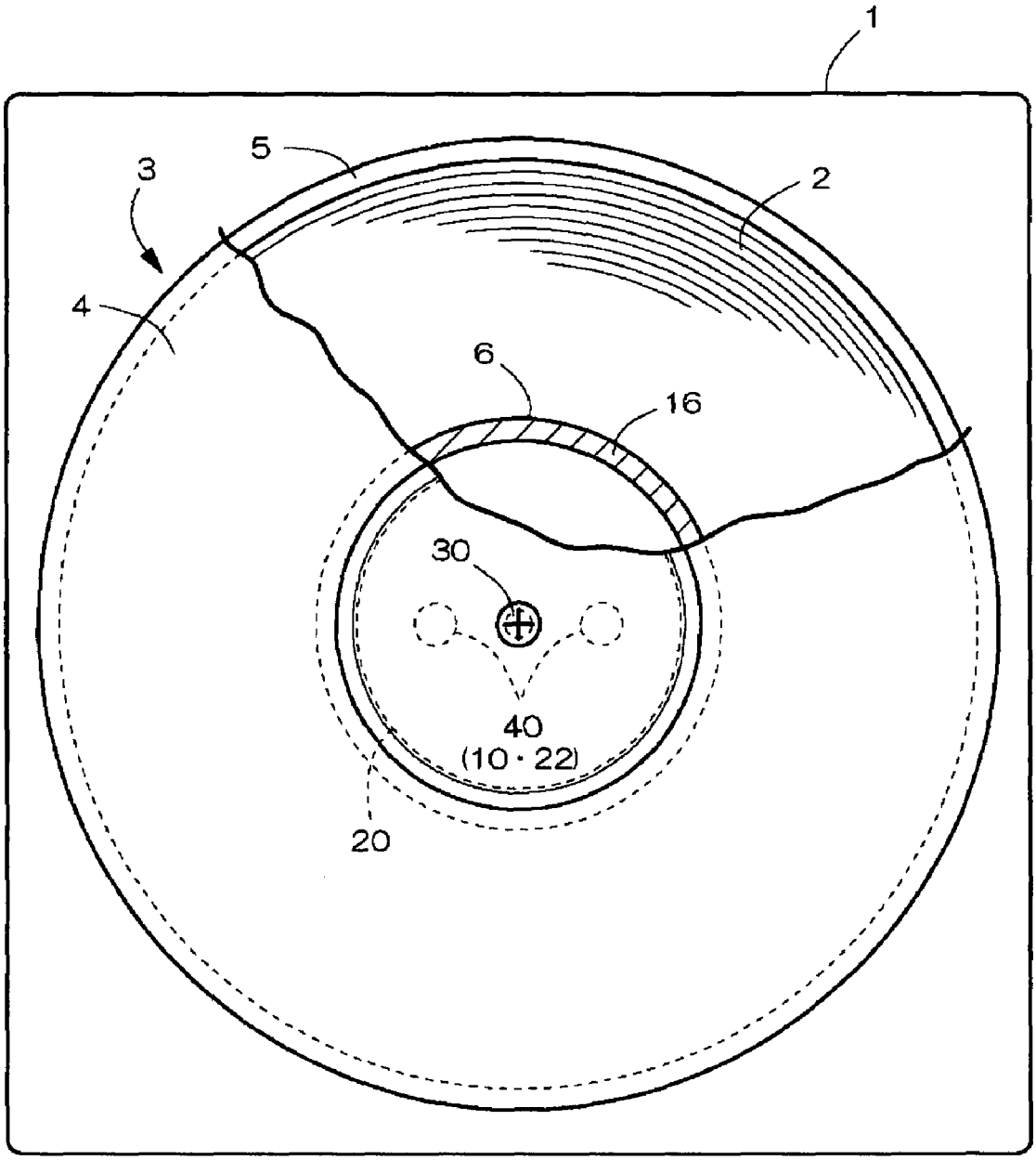
FIG. 6 is a schematic top view of the tape cartridge according to the second embodiment.
Figure 7:
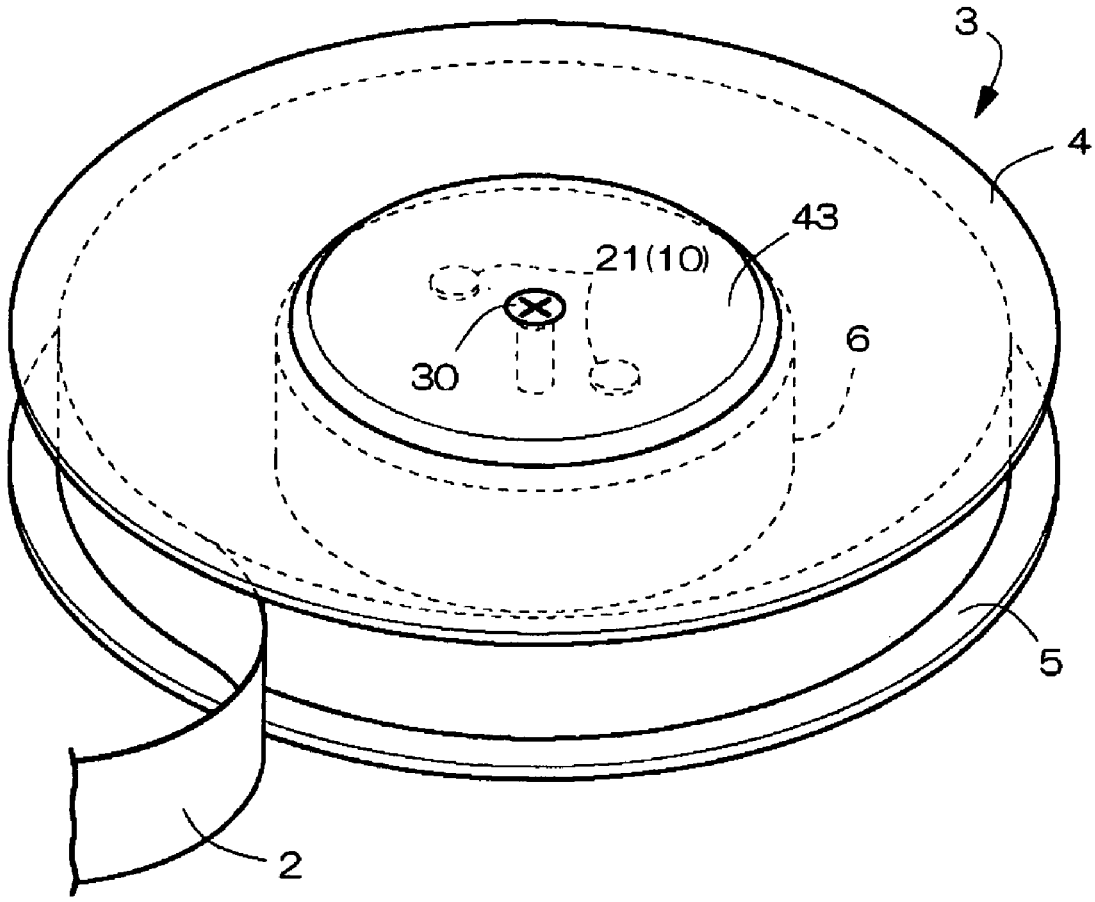
FIG. 7 is a perspective view of the tape reel according to the second embodiment.

In FIGS. 6 and 7, the tape cartridge is constituted as a so-called single reel-type tape cartridge having a tape reel 3 placed inside a box-like main casing 1 for winding and storing a recording tape 2. A leader block (unshown), which is fixed to a leading end of the magnetic tape 2, is caught and pulled out of the casing so that the magnetic tape 2 can be transmitted to a tape drive device.

As shown in FIG. 7, the tape reel 3 is composed of a pair of upper and lower disc-like flanges 4, 5, and a hub 6 around which the magnetic tape 2 is wound, the latter lower flange 5 being formed integrally with the hub 6, while the former upper flange 4 being fixed to the hub 6 via a screw fixing structure using a screw 30 as a fixing element and via an engaging structure 40 as mentioned later. As shown in FIGS. 5 and 8, the hub 6, which is in a circular shape in cross section, has, in a integral manner, a hub barrel 16 around which the magnetic tape 2 is wound and a hub end wall 17 sealing the upper surface of the hub barrel 16. The inside of the hub barrel 16 constitutes a drive hole 18 for inserting a driving shaft of a tape drive device. An engaging tooth 19 which engages with the driving shaft is formed around the upper surface of the drive hole 18. The lower flange 5 is formed extending to the lower end periphery of the hub barrel 16.

A connection seat 20 for joining and fixing the upper flange 4 is formed so as to bulge from the upper surface of hub end wall 17. The circumference of the connection seat 20 forms a staged face 45. A prepared screw hole 26 for screwing a later-described screw (screw body) 30 therein is formed in the center of the connection seat 20, and a circular recess section 21 which constitutes an engaging structure 40 mentioned later is dented and formed in two locations around the prepared hole 26. The prepared screw hole 26 is formed in the center of a screw boss 24 provided so as to protrude to the inside of the hub end wall 17. The recess section 21 is placed at two locations where a virtual circle centering on the central axis of the tape reel 3 and a diameter line passing the prepared screw hole 26 intersect.

The upper flange 4 constituted as an independent component has a central part formed to be thicker than others, and a joint recess section 8 which is to be joined to the connection seat 20 is dented and formed on the undersurface side of the heavy-walled section 43. A screw insert hole 11 is formed in the center of the heavy-walled section 43, while a circular projection 10 which fits into a recess section 21 on the side of the hub 6 is provided on the joint recess section 8 so as to protrude downward. The engaging structure 40 is composed of the recess section 21 and the projection 10 described before.

In order to fix the upper flange 4 to the hub 6 without being accompanied by heat distortion so as to achieve a high-precision tape reel 3, the upper flange 4 is mechanically fixed by the screw fixing structure which is composed of a pair of the engaging structures 40, and one screw (screw body) 30. It is to be noted that the screw 30 in this embodiment is constituted from a countersunk screw. First, the lower flange 5 and the hub 6 are stationed, the joint recess section 8 of the upper flange 4 is interfitted with the connection seat 20 of the hub 6, and the recess section 21 is interfitted and engaged with the projection 10. Thus, in the state where the hub 6 is joined to the upper flange 4, both the upper flange 4 and the hub 6 are concentrically positioned by the joint recess section 8 and the connection seat 20 and are joined by the engaging structure 40 so as not to rotate relatively. Next, as shown in FIG. 5, by screwing the screw 30 into the prepared screw hole 26 via the screw insert hole 11 with predetermined driving torque, the upper flange 4 is inseparably fastened and fixed to the hub 6, and thus the tape reel 3 is completed.

In the above-mentioned fastening state, the connection seat 20 and the joint recess section 8 are in tight contact in the thickness direction and define the assembled height of the upper flange 4, while the opening edge wall of the joint recess section 8 and the staged face 45 of the hub 6 face each other with a small interval. While the structure of the screw shaft of the screw 30 may be either a self tapping screw or a triangular screw, the former screw is preferable.

As mentioned above, if the upper flange 4 is fixed to the hub 6 by the screw fixing structure 35 using the screw 30 as a fixing element and by the engaging structure 40, the upper flange 4 and the boss 6 molded with high-accuracy form and size can be integrated while the form accuracy of both the flange and the boss is maintained high. Therefore, it becomes possible to enhance the assembled shape and the deflection width of the upper flange 4 fixed to the hub 6 as well as the taper accuracy of the flange face shown by an arrow in FIG. 5 so as to constitute a high-precision tape reel 3. Since the accuracy of all the dimensions relating to the specification of the tape reel 3 can be enhanced, the tape cartridge suitable for high density recording of information signals can be obtained. When the tape reel 3 is normally driven or reversely driven by the tape drive, the torque of the hub 6 can certainly be transmitted to the upper flange 4 via a pair of the engaging structures 40, which makes it possible to ensure that both the upper flange 4 and the hub 6 are prevented from being rotated and displaced relatively and that the screw 30 is thereby prevented from loosening.

Figure 9:
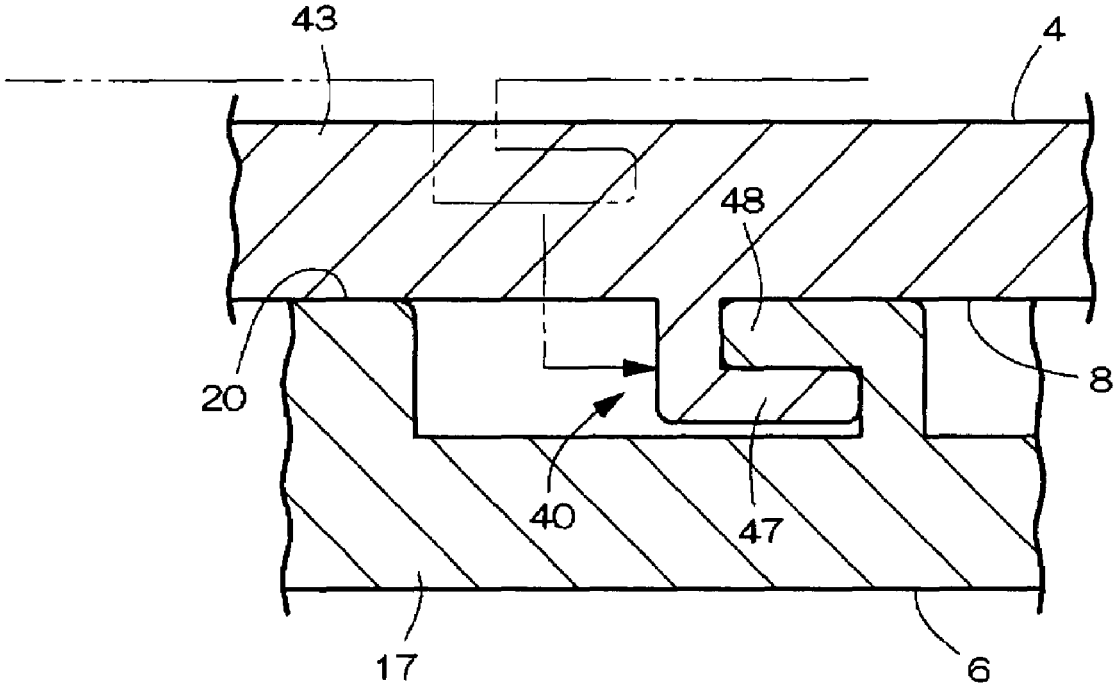
FIG. 9 is a developed cross-sectional view showing an engaging structure in another embodiment.
Figure 10:
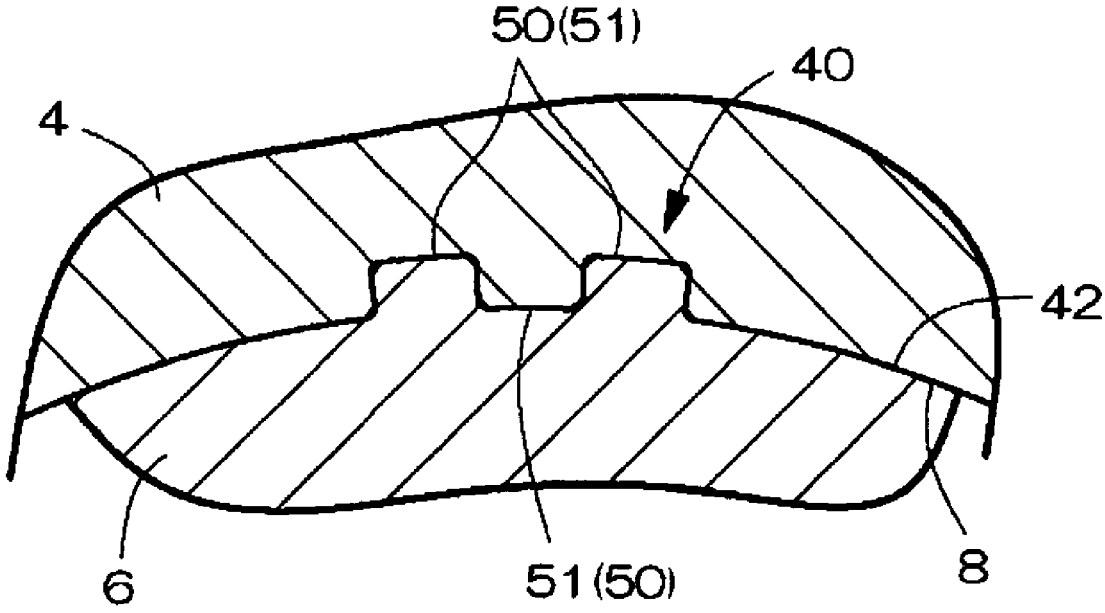
FIG. 10 is a transverse cross-sectional view showing an engaging structure in still another embodiment.

A modified example in the second embodiment of the present invention is shown in FIGS. 9 and 10. In FIG. 9, clasp-shaped engaging bodies 47, 48 which engage with each other in the circumferential direction were provided on both opposed faces between the joint recess section 8 of the upper flange 4 and the connection seat 20 of the hub 6, and an engaging structure 40 is composed of these engaging bodies 417, 48. The engaging structure 40 was evenly placed at two or more locations around the central axis of the screw 30. By rotationally operating the flange 4 around the central axis of the screw 30 as shown by an imaginary line, both the engaging bodies 47, 48 engage with each other, so that rotation of the flange 4 in the direction of loosening the screw 30 can be regulated. Since other structures are identical to the previous embodiment, like component members are designated by like reference numerals to omit description.

In FIG. 10, the engaging structure 40 was provided in two or more locations on the interfitting surface of the joint recess section 8 of the flange 4 and the connection seat 20 of the hub 6, and the engaging structure 40 is composed of a projection 50 and a recess section 51 which were interfitted in the diameter direction. More specifically, two recess sections 51 and one projection 50 were provided on the interfitting surface of the joint recess section 8, while two projections 50 and one recess section 51 were formed on the interfitting surface of the connection seat 20, so that these projections 50 and recess sections 51 were to engage with each other in the diameter direction like a spline shaft and a spline hole.

The shape of the projections 10, 50 and the recess sections 21, 51 is not limited to the shape explained in the above embodiment and can be changed to arbitrary shapes where necessary. The operation head of the screw 30 does not need to be in a flat head shape, and screws with an operation head having an arbitrary shape are applicable. The screw 30 includes hexagon headed bolts. The engaging structure 40 can be composed of one projection 50 and one recess section 51. The present invention is also applicable to the tape cartridge having two tape reels 3 in the main casing 1. The present invention includes the case where each of the upper and lower flanges 4, 5 is fixed to the hub 6 by the engaging structure 40 and the screw fixing structure 35 using the screw 30 as a fixing element.

Third Embodiment

Figure 11:
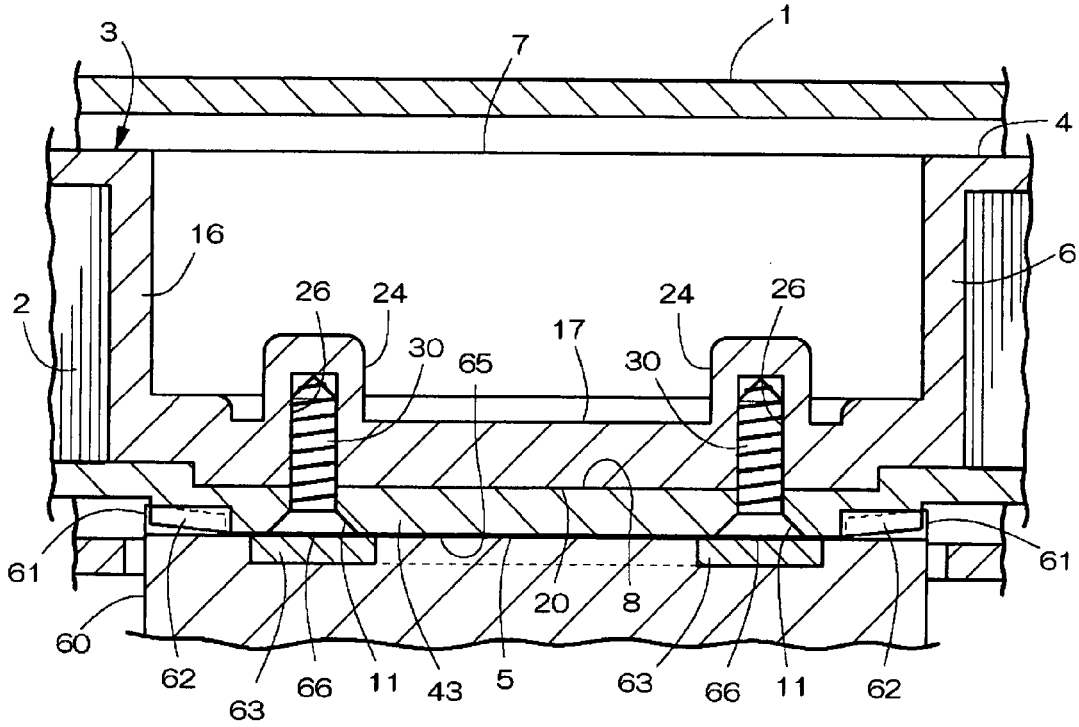
FIG. 11 is a vertical cross sectional front view showing a driving mechanism of a tape reel constituting a tape cartridge according to a third embodiment of the present invention.

A tape cartridge in the third embodiment of the present invention is shown in FIG. 11 through FIG. 15. In FIGS. 11, the tape cartridge is constituted as a so-called single reel-type tape cartridge having a tape reel 3 placed inside a box-like main casing 1 for winding and storing a recording tape 2. Although not illustrated, a leader tape is connected to a leading end of the magnetic tape 2, and a leader block is fixed to its free end.

Figure 12:
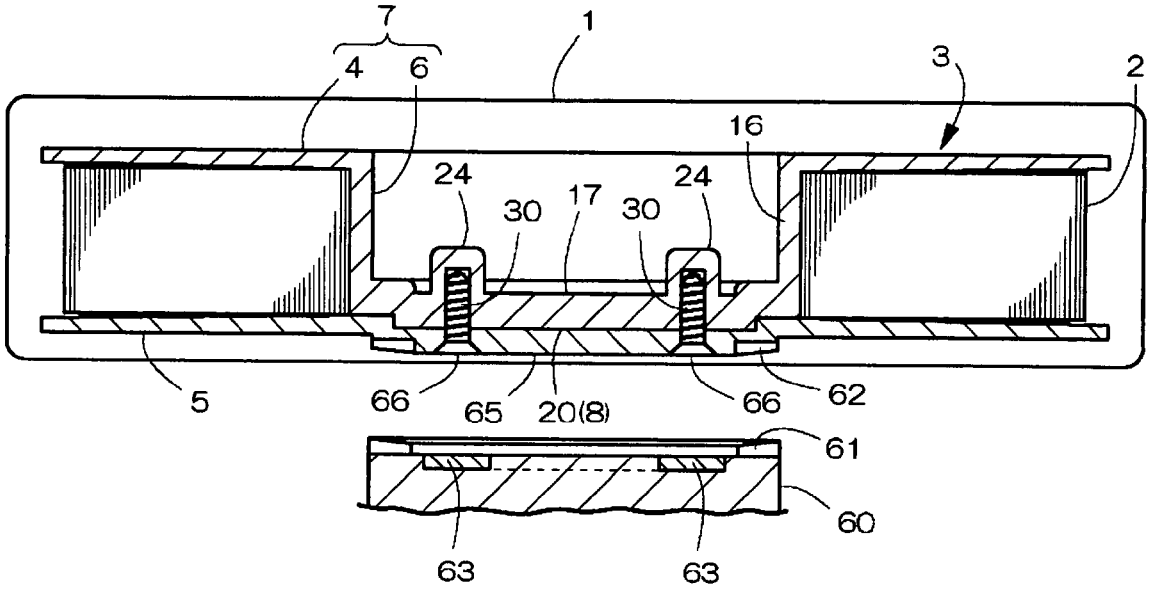
FIG. 12 is a vertical cross-sectional view of the tape reel.
Figure 13:
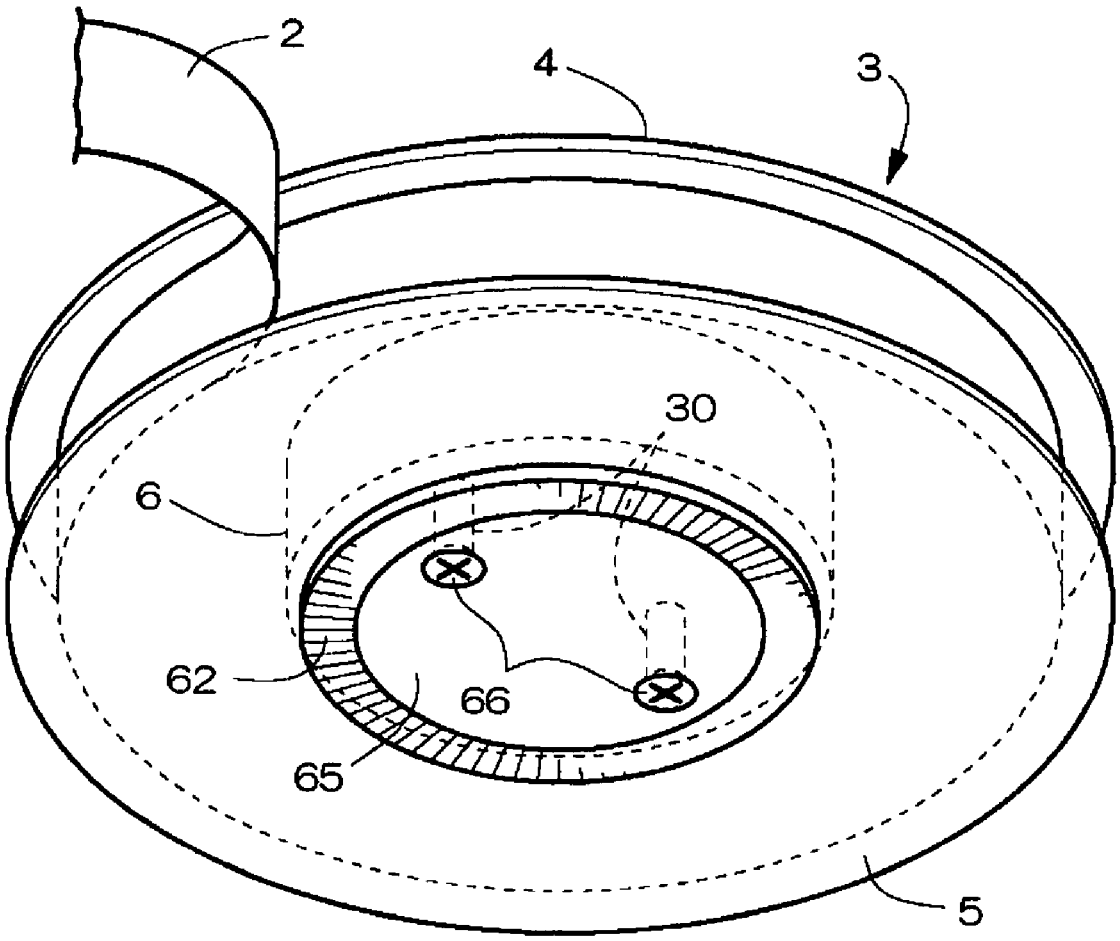
FIG. 13 is a perspective view of the tape reel according to the third embodiment.
Figure 14:
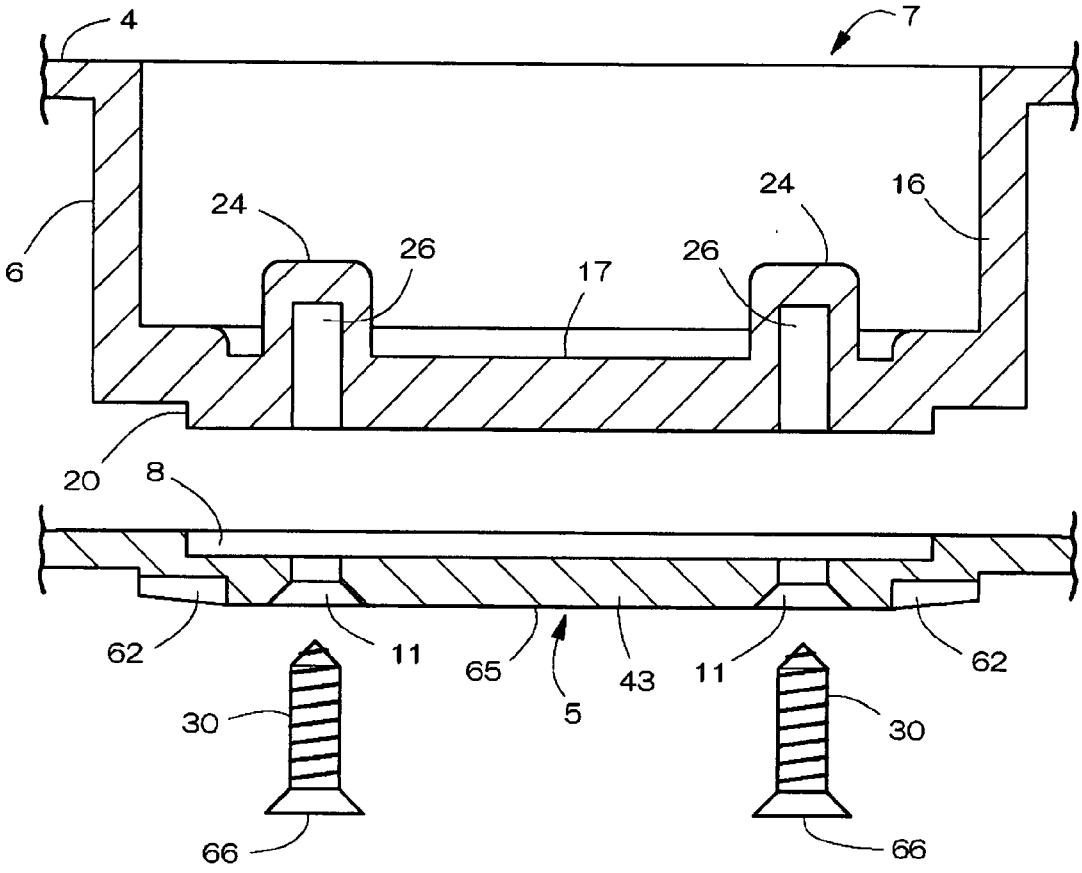
FIG. 14 is an exploded cross-sectional view of the tape reel according to the third embodiment.

As shown in FIG. 12, the tape reel 3 is composed of a reel body 7 and a disc-like lower flange 5. The reel body 7 is constituted from a plastic molding having, in an integral manner, a disc-like upper flange 4 and a hub 6 around which the magnetic tape 2 is wound. The hub 6, which is composed of a hub barrel 16 having a circular cross section and a hub end wall 17 sealing the lower end of the hub barrel 16, is formed in the shape of a barrel opening upward, with an upper flange 4 being integrally formed on the periphery of the hub opening. As shown in FIG. 11, a pair of right and left screw bosses 24, 24 are integrally formed in the inside of the hub end wall 17, while a connection seat 20 for joining the lower flange 5 is formed so as to bulge on the undersurface of the hub end wall 17. A prepared screw hole 26 for screwing a screw (screw body) 30 mentioned later is formed in the screw boss 24.

A heavy-walled section 43 thicker than the circumferential wall is formed in the central part of the lower flange 5 constituted as an independent component. A joint recess section 8 which is to be joined to the connection seat 20 is dented and formed on the surface side of the heavy-walled section 43. A passive gear 62 which gears with a gear drive 61 provided in a driving shaft 60 of a tape drive is formed in the periphery of the heavy-walled section 43 in a circumferential state. A screw insert hole 11 corresponding to the prepared screw hole 26 is formed at two locations inside the gear sequence. A magnet 63 is buried and fixed inside the gear sequence of the gear drive 61 provided in the driving shaft 60 (see FIGS. 11 and 12).

In order to fix the lower flange 5 to the hub 6 free from heat distortion, the lower flange 5 is fastened with two screws 30. More specifically, the reel body 7 is stationed in the state that the upper flange 4 is under the reel body 7, the joint recess section 8 of the lower flange 5 is interfitted with the connection seat 20 of the hub 6, and the center of the screw insert hole 11 is coincided with the center of the prepared screw hole 26. Thus, in the state where the lower flange 5 is interfitted and engaged with the hub 6, both the lower flange 5 and the hub 6 are concentrically positioned by the joint recess section 8 and the connection seat 20. In this state, by screwing the screw 30 into the prepared screw hole 26 via the screw insert hole 11 with predetermined driving torque, the lower flange 5 is inseparably fastened and fixed to the hub 6, and thus the tape reel 3 can be completed.

In the present invention, the screw 30 is attracted by the magnet 63 of the driving shaft 60, so that the engagement state of the gear drive 61 and the passive gear 62 at the time of rotational driving of the tape reel 3 can be maintained. To this end, the screw 30 is formed from magnetically attractable magnetic metal, such as magnetically attractable steel materials and stainless steel materials. Further, the screw 30 is placed in a ring-shaped region of the reel end wall 65 right opposite to the magnet 63 provided in the driving shaft 60. The straight line which connects the central axes of two screws 30, 30 passes the rotation axis of the tape reel 3, so that an interval between both the screws 30, 30 in the circumferential direction is set equally.

In order to attract the screw 30 effectively with the magnet 63, an attracting face 66 is formed in the outer edge of the operation head of the screw 30. In this embodiment, the attracting face 66 was formed by taking advantage of the fact that the outer edge of the operation head of the screw 30 is a flat face. In short, in this embodiment, a countersunk screw was used as the screw 30. In the state where the screw 30 is completely screwed into the prepared screw hole 26, the taper surface of the operation head is received by the screw seat of the screw insert hole 11, so that the attracting face 66 becomes flush with the reel end wall 65. The diameter dimension of the attracting face 66 is set to be equal to or slightly smaller than the width dimension of the magnet 63. It is to be noted that the structure of the screw shaft of the screw 30 may be either a self tapping screw or a triangular screw, though the former screw is preferable.

As mentioned above, if the lower flange 5 is fixed to the hub 6 with the screw 30, the lower flange 5 and the hub 6 molded with high-accuracy form and size can be integrated while the form accuracy of both the flange and the hub is maintained high. Therefore, it becomes possible to enhance the assembled shape and the deflection width of the lower flange 5 fixed to the hub 6 as well as the taper accuracy of the flange face so as to constitute a high-precision tape reel 3. As a result, a tape cartridge suitable for high density recording of information signals can be obtained.

Since the screw 30 for fastening and fixing the lower flange 5 is attracted by the magnet 63 to maintain the engagement state of the gear drive 61 and the passive gear 62, this brings about an advantage that the ring-shaped attracting plate, which should be inserted and fixed to the tape reel 3 side in the conventional magnetic attraction structure, can be omitted, an advantage that the structure of the molding die can be simplified, and further an advantage that the lower flange 5 can easily be fastened and fixed to the hub 6 with the screw 30. These advantages make it possible to achieve a high-accuracy tape reel 3 as a whole while reducing its costs.

Figure 15:
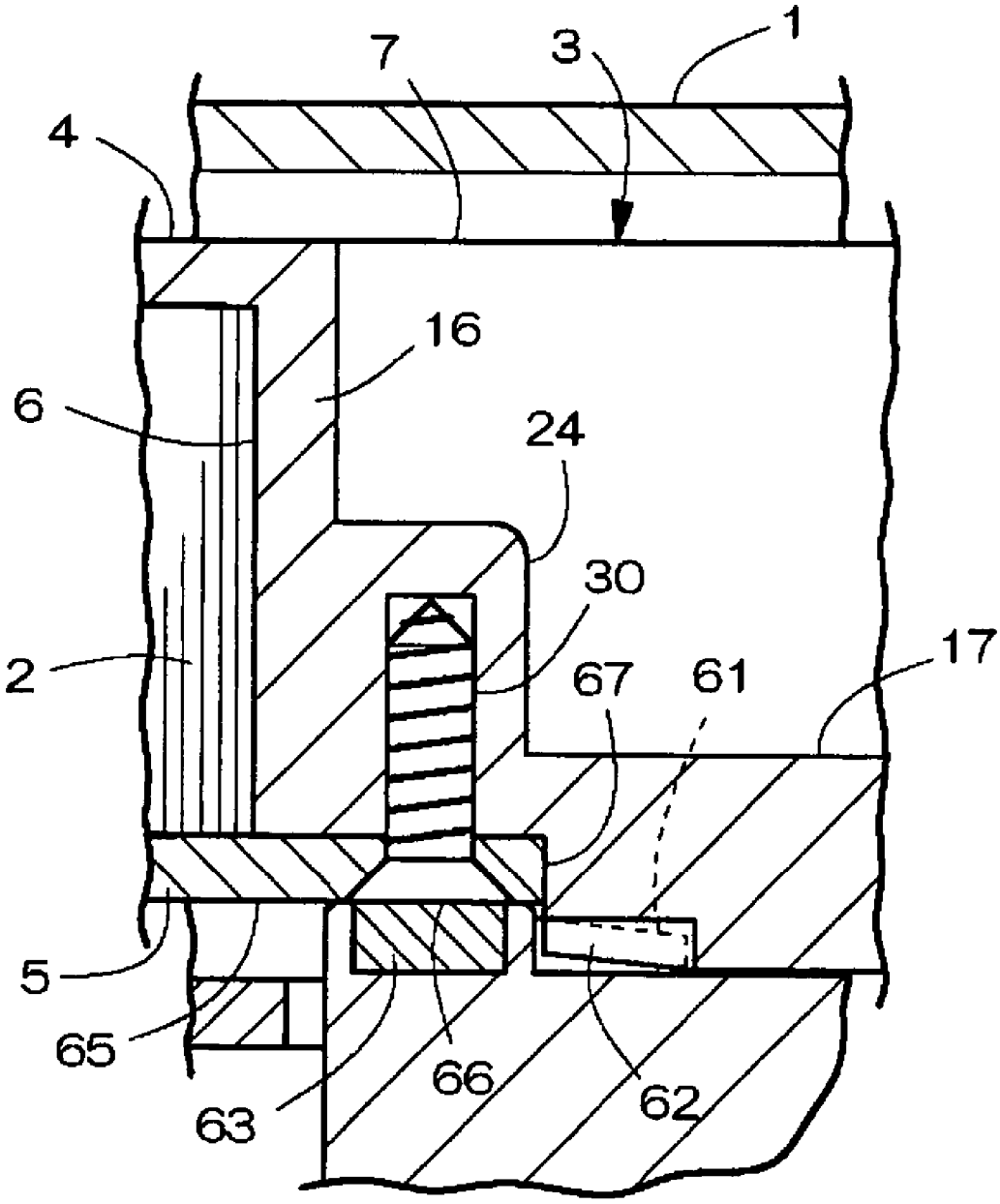
FIG. 15 is a vertical cross sectional view of main sections of a tape reel in another embodiment.

FIG. 15 shows a tape reel 3 in another embodiment. In this embodiment, a passive gear 62 was formed on the hub end wall 17 in a circumferential state, and a screw insert hole 11 was provided in the reel end wall 65 outside the passive gear 62 to fasten and fix the lower flange 5 to the hub 6. A hole 67 for exposing the passive gear 62 is formed in the center of the heavy-walled section 43 of the lower flange 5. Since others structures are identical to the previous embodiment, like component members are designated by like reference numerals to omit description.

The screw 30 does not need to be a countersunk screw as in the above embodiment, and any screw body with its operation head having a flat outer edge such as flat fillister head screws, hexagon headed bolts, volts with hexagon socket is applicable. It is possible to use exclusive screws with the diameter of the operation head being set larger than that of commercial screws or machine screws. The screw 30 should be provided in plurality and it is preferable that a plurality of the screws 30 be evenly placed in the circumferential direction. If necessity, a washer-like attracting body formed from magnetically attractable magnetic metal can be fastened and fixed together with the screws 30 to increase the attraction area in proportion to the addition of the attractant, so that the attracting force by the magnet 63 can be reinforced. The present invention includes the case where each of the upper and lower flanges 4, 5 is fastened to the hub 6 with the screw 30.

Although the present invention has been described in detail with reference to the accompanying drawings, various variations and modifications are possible for those skilled in the art. Therefore, it should be understood that such variations and modifications that come within the scope and the spirit of the present invention are intended to be embraced therein.

What is claimed is:

1. A tape cartridge, comprising a tape reel placed inside a main casing for winding and storing a recording tape, the tape reel being constituted from a pair of upper and lower flanges and a hub, wherein at least one flange is fastened and fixed by a screw fixing structure which uses, as a fixing element, a screw body screwed into the hub from an external surface side of the flange, the tape cartridge further comprising an engaging structure provided in joint surfaces of the hub and the flange so as to be engaged with each other, wherein the engaging structure is constituted from a joint recess section provided in any one of the hub and the flange, and a connection seat provided in the other one of the hub and the flange, the connection seat being fitted into the joint recess section.

2. The tape cartridge according to claim 1, wherein the screw body is located so that a screw shaft center of the screw body is positioned on a central axis of rotation of the tape reel.

3. The tape cartridge according to claim 1, wherein the screw body in the screw fixing structure is provided at a position away from a central axis of rotation of the tape reel.

4. The tape cartridge according to claim 1, wherein the flange is fastened and fixed to the hub by a plurality of the screw bodies.

5. The tape cartridge according to claim 1, wherein the joint recess section is provided in a center of the flange while the connection seat is provided in a hub end wall of the hub.

6. The tape cartridge according to claim 1, wherein the screw body is made from magnetically attractable magnetic metal, wherein the screw body is provided on a reel end wall right opposite to a magnet provided in a driving shaft of a tape drive.

7. The tape cartridge according to claim 1, wherein the screw body is made from magnetically attractable magnetic metal, wherein a plurality of the screw bodies are provided on a reel end wall right opposite to a magnet provided in a driving shaft of a tape drive, and wherein a plurality of the screw bodies are right opposite to the magnet provided in the driving shaft of the tape drive and are placed at regular intervals in a circumferential direction in a ring-shaped region of the reel end wall which are joined to the magnet.

8. The tape cartridge according to claim 1, wherein the screw body is made from magnetic metal capable of magnetic absorption, wherein the screw body is provided on a reel end wall right opposite to a magnet provided in a driving shaft of a tape drive, and wherein an attracting face constituted from a flat face flush with the reel end wall is formed at an outer edge of an operation head of the screw body.

9. A tape cartridge, comprising a tape reel placed inside a main casing for winding and storing a recording tape, the tape reel being constituted from a pair of upper and lower flanges and a hub, wherein at least one flange is fastened and fixed by a screw fixing structure which uses, as a fixing element, a screw body screwed into the hub from an external surface side of the flange, the tape cartridge further comprising: the screw fixing structure; and at least one engaging structure which is provided in joint surfaces of the hub and the flange so as to be engaged with each other, wherein a plurality of the engaging structures are evenly placed on a virtual circle centering on a rotational center of the tape reel, and wherein the engaging structure is constituted from a projection and a recess section which interfit in a joint direction of the flange and the hub.

10. The tape cartridge according to claim 9, wherein the screw body is located so that a screw shaft center of the screw body is positioned on a central axis of rotation of the tape reel.

11. The tape cartridge according to claim 9, wherein the screw body in the screw fixing structure is provided at a position away from a central axis of rotation of the tape reel.

12. The tape cartridge according to claim 9, wherein the flange is fastened and fixed to the hub by a plurality of the screw bodies.

13. The tape cartridge according to claim 9, wherein the screw body is made from magnetically attractable magnetic metal, wherein the screw body is provided on a reel end wall right opposite to a magnet provided in a driving shaft of a tape drive.

14. The tape cartridge according to claim 9, wherein the screw body is made from magnetically attractable magnetic metal, wherein a plurality of the screw bodies are provided on a reel end wall right opposite to a magnet provided in a driving shaft of a tape drive, and wherein a plurality of the screw bodies are right opposite to the magnet provided in the driving shaft of the tape drive and are placed at regular intervals in a circumferential direction in a ring-shaped region of the reel end wall which are joined to the magnet.

15. The tape cartridge according to claim 9, wherein the screw body is made from magnetic metal capable of magnetic absorption, wherein the screw body is provided on a reel end wall right opposite to a magnet provided in a driving shaft of a tape drive, and wherein an attracting face constituted from a flat face flush with the reel end wall is formed at an outer edge of an operation head of the screw body.

16. A tape cartridge, comprising a tape reel placed inside a main casing for winding and storing a recording tape, the tape reel being constituted from a pair of upper and lower flanges and a hub, wherein at least one flange is fastened and fixed by a screw fixing structure which uses, as a fixing element, a screw body screwed into the hub from an external surface side of the flange, the tape cartridge further comprising: the screw fixing structure; and at least one engaging structure provided in joint surfaces of the hub and the flange so as to be engaged with each other, wherein a plurality of the engaging structures are evenly placed on a virtual circle centering on a rotational center of the tape reel, and wherein the engaging structure is constituted from a clasp-shaped engaging body provided on opposed faces of the flange and the hub so as to be engaged with each other in a circumferential direction.

17. The tape cartridge according to claim 16, wherein the screw body is located so that a screw shaft center of the screw body is positioned on a central axis of rotation of the tape reel.

18. The tape cartridge according to claim 16, wherein the screw body in the screw fixing structure is provided at a position away from a central axis of rotation of the tape reel.

19. The tape cartridge according to claim 16, wherein the flange is fastened and fixed to the hub by a plurality of the screw bodies.

20. The tape cartridge according to claim 16, wherein the screw body is made from magnetically attractable magnetic metal, wherein the screw body is provided on a reel end wall right opposite to a magnet provided in a driving shaft of a tape drive.

21. The tape cartridge according to claim 16, wherein the screw body is made from magnetically attractable magnetic metal, wherein a plurality of the screw bodies are provided on a reel end wall right opposite to a magnet provided in a driving shaft of a tape drive, and wherein a plurality of the screw bodies are right opposite to the magnet provided in the driving shaft of the tape drive and are placed at regular intervals in a circumferential direction in a ring-shaped region of the reel end wall which are joined to the magnet.

22. The tape cartridge according to claim 16, wherein the screw body is made from magnetic metal capable of magnetic absorption, wherein the screw body is provided on a reel end wall right opposite to a magnet provided in a driving shaft of a tape drive, and wherein an attracting face constituted from a flat face flush with the reel end wall is formed at an outer edge of an operation head of the screw body.

23. A tape cartridge, comprising a tape reel placed inside a main casing for winding and storing a recording tape, the tape reel being constituted from a pair of upper and lower flanges and a hub, wherein at least one flange is fastened and fixed by a screw fixing structure which uses, as a fixing element, a screw body screwed into the hub from an external surface side of the flange, the tape cartridge further comprising: the screw fixing structure; and at least one engaging structure provided in joint surfaces of the hub and the flange so as to be engaged with each other, wherein the flange and the hub are interfitted and engaged with each other on the joint surfaces thereof in a joint direction, wherein a plurality of the engaging structures are evenly placed along an interfitting surface of the flange and the hub, and wherein the engaging structure is constituted from a projection and a recess section which interfit in a diameter direction on the interfitting and engaging surface.

24. The tape cartridge according to claim 23, wherein the screw body is located so that a screw shaft center of the screw body is positioned on a central axis of rotation of the tape reel.

25. The tape cartridge according to claim 23, wherein the screw body in the screw fixing structure is provided at a position away from a central axis of rotation of the tape reel.

26. The tape cartridge according to claim 23, wherein the flange is fastened and fixed to the hub by a plurality of the screw bodies.

27. The tape cartridge according to claim 23, wherein the screw body is made from magnetically attractable magnetic metal, wherein the screw body is provided on a reel end wall right opposite to a magnet provided in a driving shaft of a tape drive.

28. The tape cartridge according to claim 23, wherein the screw body is made from magnetically attractable magnetic metal, wherein a plurality of the screw bodies are provided on a reel end wall right opposite to a magnet provided in a driving shaft of a tape drive, and wherein a plurality of the screw bodies are right opposite to the magnet provided in the driving shaft of the tape drive and are placed at regular intervals in a circumferential direction in a ring-shaped region of the reel end wall which are joined to the magnet.

29. The tape cartridge according to claim 23, wherein the screw body is made from magnetic metal capable of magnetic absorption, wherein the screw body is provided on a reel end wall right opposite to a magnet provided in a driving shaft of a tape drive, and wherein an attracting face constituted from a flat face flush with the reel end wall is formed at an outer edge of an operation head of the screw body.

* * * * *